US007008140B2

(12) United States Patent
Copple et al.

(10) Patent No.: US 7,008,140 B2
(45) Date of Patent: Mar. 7, 2006

(54) BUOYANT LEG STRUCTURE WITH ADDED TUBULAR MEMBERS FOR SUPPORTING A DEEP WATER PLATFORM

(76) Inventors: Robert W. Copple, 5 Glen Dr., Mill Valley, CA (US) 94941; Cuneyt C. Capanoglu, 1215 Encina Dr., Millbrae, CA (US) 94030; David W. Kalinowski, 11 Howell La., Surgar Land, TX (US) 77479

( * ) Notice: Subject to any disclaimer, the term of this patent is extended or adjusted under 35 U.S.C. 154(b) by 0 days.

(21) Appl. No.: 10/914,793

(22) Filed: Aug. 9, 2004

(65) Prior Publication Data

US 2005/0019102 A1 Jan. 27, 2005

Related U.S. Application Data

(62) Division of application No. 10/308,299, filed on Dec. 2, 2002, now Pat. No. 6,783,302.

(51) Int. Cl.
*B63B 35/44* (2006.01)

(52) U.S. Cl. ..... 405/224; 405/224.2; 405/195.1; 114/265; 114/266

(58) Field of Classification Search ..... 405/200, 405/205, 228, 223.1, 224, 224.2; 114/256, 114/264–266
See application file for complete search history.

(56) References Cited

U.S. PATENT DOCUMENTS

| | | | | |
|---|---|---|---|---|
| 4,703,709 | A * | 11/1987 | Behar et al. | 114/256 |
| 5,704,731 | A * | 1/1998 | Huang | 405/223.1 |
| 6,190,089 | B1 * | 2/2001 | Bennett et al. | 405/200 |
| 6,206,614 | B1 * | 3/2001 | Blevins et al. | 405/224 |
| 6,783,302 | B1 * | 8/2004 | Copple et al. | 405/195.1 |
| 6,817,309 | B1 * | 11/2004 | Horton | 114/264 |

* cited by examiner

*Primary Examiner*—Frederick L. Lagman
(74) *Attorney, Agent, or Firm*—Sheppard Mullin Richter & Hampton LLP

(57) ABSTRACT

A deep water support platform, suitable for use as a hydrocarbon exploration or production facility in very deep waters of 10,000 ft or more is presented. The platform is attached to the floor of the ocean with a buoyant pile that includes buoyant members attached about the periphery of the pile. The buoyant pile and buoyant members include tubular members that can be filled with water, oil, air or other materials to produce a structure that has improved buoyancy and stability over prior platforms. Embodiments include configurations of buoyant members that have constant and equal diameter and spacing, and other configurations where the diameter and/or spacing of the buoyant members changes along the pile. In addition, the buoyant members are arranged about the pile to reduce vortex induced vibrations on the platform by interfering with current flow about the support structure.

20 Claims, 10 Drawing Sheets

BUOYANT LEG STRUCTURE WITH ADDED TUBULAR MEMBERS FOR SUPPORTING A DEEP WATER PLATFORM

CROSS-REFERENCE TO RELATED APPLICATION

This application claims priority as a division of allowed U.S. patent application Ser. No. 10/308,299, filed Dec. 2, 2002 now U.S. Pat. No. 6,783,302, the entire disclosure of which is incorporated by reference.

FIELD OF THE INVENTION

The present invention relates to permanently affixed support structures for conducting operations in deep-water and, in particular, structures used to support deepwater, offshore platforms used in connection with oil and gas exploration and extraction.

BACKGROUND OF THE INVENTION

Offshore platforms are used to provide stable and safe locations above the ocean surface for drilling and other operations associated with the exploration and extraction of oil and gas resources. While offshore platforms have been used by the oil and gas industry for many years in relatively shallow waters, such as the Gulf of Mexico or the North Sea, the increasing demand for energy has created the need to exploit oil and gas resources from deepwater locations. Many of the traditional offshore platform designs used for shallow water applications are not practically adaptable for use in deeper waters. In addition, the platform designs that are in use, or which have been proposed for use in deep water locations have various disadvantages and limitations.

The design of offshore platforms presents many structural engineering challenges. Such platforms are subjected to severe environmental forces associated with the movement of the surrounding water and air. The platform responds to these forces by moving, to some degree, in several ways, including horizontal movement along the surface in direct response to an applied force, rolling (side-to-side rocking along an axis in the direction of the prevailing current), pitching (side-to-side rocking along an axis perpendicular to the direction of the prevailing current), yawing (rotation about the vertical), heaving (up and down motion), surging (an offset in the direction of the current about the anchorage), and swaying (an offset sideways about the anchorage). The structure must be able to withstand periodic forces that are capable of inducing vibration, possibly causing at oscillating frequencies of the structure. These movements, while unavoidable, must be constrained within acceptable limits by the structural design of the platform. This, in turn, imposes limitations on the various components used in the design. The limits on what constitutes acceptable movement of the platform is normally determined by the nature of the operations that are intended to occur on or near the structure, such as the operation of drilling equipment and the docking of ships or landing of helicopters on a platform, the protection of risers from the seabed to the platform, and the support of risers that pass into the seabed. The structure and any occupants must also be able to safely ride the high winds and seas of storms.

Deepwater platforms in use, or which have been proposed, include (1) tension leg platforms (TLPs) that are fixed at a location with generally vertical tendons anchored to the seabed that are in tension and are connected to a floating platform, (2) catenary moored systems such as semi-submersible floating structures and spar-like floating structures that are stabilized with cables anchored to the seabed and forming a catenary between the floating platform, and (3) buoyant leg structure (BLS), sometimes referred to as a buoyant "pile" structure. Buoyant leg structures are described in the following U.S. patents, incorporated herein by reference: U.S. Pat. Nos. 5,118,221, 5,443,330, and 5,683,206 to Copple, and U.S. Pat. No. 6,012,873 to Copple et al. (the "Copple patents"). For reasons described in the Copple patents, the buoyant upper portions of a BLS provide added stability against environmental forces.

There are several features that are common to buoyant leg structures. A BLS includes one or more hollow members that form a column that extends downwards from the surface of the water towards the seabed. The hollow members can be formed, for example, from stacked compartments or from an elongated hollow member, such as a pipe or tube. The column is anchored to the seabed, either directly or by a tether. The hollow members have a lower portion that is partially filled with seawater or can be used for storing oil, and an upper portion that is emptied to provide predetermined buoyancy. For BLSs formed from elongated hollow members, a watertight bulkhead provides partitioning between the lower portion and upper portion. The center of buoyancy is above the center of gravity, so that when the top of the BLS is displaced by currents or winds, a righting moment tends to straighten the BLS. Another characteristic of a BLS is that the lower portion of the BLS is in tension and the upper portion of the BLS is in compression.

While the BLS designs described in the Copple patents disclose structures wherein the buoyant leg is directly anchored to the seabed, subsequent BLS designs contemplated by the inventors are anchored by a tether enabling use at water depths much greater than alternative deepwater platforms-perhaps to depths of 10,000 feet or more. At these greater depths, the natural oscillating period of a BLS increases in heave, and may correspond to periods having substantial wave energy. When this occurs, energy from the waves can couple into the BLS, producing large up and down platform motions. Prior buoyant leg structures have a limited ability to design around this problem.

Therefore, it is one aspect of the present invention is to provide a BLS having added stability in deep water.

It is another aspect of the present invention is to provide an offshore deep-water platform suitable for use at great depths that has increased buoyancy.

It is yet another aspect of the present invention is to provide an offshore deep-water platform suitable for use at great depths that has increased buoyancy for supporting heavier platforms.

It is one aspect of the present invention to provide an offshore deep-water platform that is less susceptible to vortex shedding and to vortex induced vibrations.

Another aspect of the present invention is to provide an offshore deep-water platform that is simple in design, and which is relatively easy and inexpensive to construct, moor and operate.

SUMMARY OF THE INVENTION

The present invention solves the above-identified problems of prior BLS systems by providing a BLS having increased buoyancy and mass. In accordance with one aspect of the present invention, the BLS has a buoyant leg anchored to the seabed and provides added buoyancy through a plurality of buoyant members attached to the upper end of the buoyant leg. In one embodiment, the buoyant members are cylindrical, and they are aligned with and connected to the upper portion of the buoyant leg.

In accordance with another aspect of the present invention, a tethered BLS having additional ballast in the buoyant unit is provided having a natural period in heave that does not correspond with the energy spectra of the water.

In accordance with yet another aspect of the present invention, a deep-water support system for supporting a structure adjacent to the surface of a body of water at a pre-selected site is provided by an apparatus having at least one buoyant pile and at least two buoyant tubular members having elongate shapes. The pile has a lower end anchored to the bottom of a body of water and an upper portion for mounting the structure. The pile is also at least partially filled with a buoyant material. The tubular members are connected to the upper portion and are also at least partially filled with buoyant material to increase the buoyancy of the pile. In another embodiment of the present invention, the pile is anchored to the bottom of a body of water by a tether.

In accordance with another aspect of the present invention, a deep-water support system for supporting a structure adjacent to the surface of a body of water at a pre-selected site is provided to reduce vortex-induced vibrations in the structure.

In accordance with yet another aspect of the present invention, vortex-induced vibrations are reduced by providing spacing between buoyant members that varies along the length of the members. In accordance with another aspect of the present invention, vortex-induced vibrations are reduced by providing buoyant members diameters that vary along the length of the members. In accordance with yet another aspect of the present invention, vortex-induced vibrations are reduced by providing about the structure buoyant members of different.

A further understanding of the invention can be had from the detailed discussion of the specific embodiments below. A BLS platform according to the present invention may include buoyant or non-buoyant members that differ from these embodiments, or may be assembled in way that differ from these embodiments. It is therefore intended that the invention not be limited by the discussion of specific embodiments.

Additional objects, advantages, aspects and features of the present invention will become apparent from the description of embodiments set forth below.

BRIEF DESCRIPTION OF THE DRAWINGS

The foregoing aspects and the attendant advantages of the present invention will become more readily appreciated by reference to the following detailed description, when taken in conjunction with the accompanying drawings, wherein.

Reference symbols are used in the Figures to indicate certain components, aspects or features shown therein, with reference symbols common to more than one Figure indicating like components, aspects or features shown therein:

DETAILED DESCRIPTION OF THE INVENTION

Figure 1:
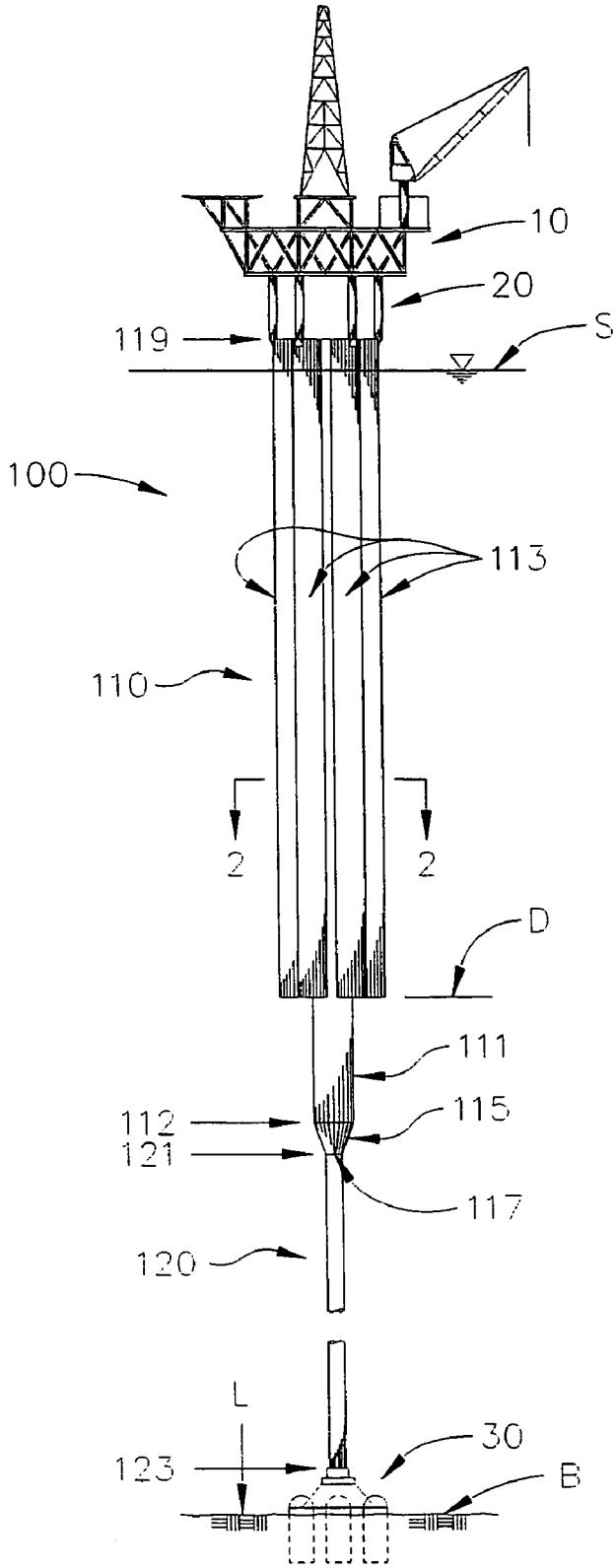
FIG. 1 is a side view of a first embodiment of a buoyant leg structure of the present invention.

To facilitate its description, the invention is described below in terms of specific embodiments and with reference to the Figures. FIG. 1 is a side view of a first embodiment of a BLS 100 of the present invention. In general, BLS 100 includes an upper buoyant unit 110 and a lower restraining unit 120. BLS 100 is shown with buoyant unit 110 supporting a platform 10 with a frame 20 above a surface S of a body of water and with restraining unit 120 moored to seabed B, in a depth of water depth L, with an anchorage 30. While BLS 100 is shown above surface S, it is understood that waves may occasionally rise above the BLS, possibly to the level of platform 10. Platform 10, frame 20, and anchorage 30 are conventional or conventionally designed items that are shown to place the invention in context of one use of a BLS, and are not intended to limit the scope of the present invention.

Buoyant unit 110 extends from an upper end 119 to a lower end 112 at transition unit 115, and restraining unit 120 extends from an upper end 121 at the transition unit to a lower end 123. Also extending at least a portion of the length of BLS 100 is an elongated tubular member 111 that is similar to those described in the Copple patents. In general, elongated tubular member 111 can be anchored to the seabed, as in the first embodiment, or can be tethered to the seabed, as discussed subsequently. For embodiments where member 111 is anchored to the seabed, it is proper to refer to this member as pile 111. Since the elongated tubular member of the BLS is not necessarily anchored, it is thus understood that the term "pile" is not meant to limiting the scope of the claims, but is used only to denote elongated tubular member of an anchored BLS. Pile 111 of the first embodiment extends the length of buoyant unit 110 and restraining unit 120, and includes a transition unit 115. Several elongate buoyant members 113 are arranged about and attached to pile 111 to form part of the buoyant unit 110, while restraining unit 120 consists primarily of the pile. Restraining unit lower end 123 is moored to seabed B by anchorage 30.

Pile 111 is generally an elongate structure of tubular, watertight construction. At least one bulkhead 117 is provided at an intermediate location along the length of pile 111, such as near transition unit 115, to divide the pile into an upper, buoyant portion and a lower, non-buoyant portion, and to prevent or control movement along the pile of materials such as water, air, oil or other buoyant or ballast materials. In a preferred embodiment, the cross-sectional area of pile 111 decreases from the buoyant unit upper end 119 to the restraining unit lower end 123, with the change in area being either step-wise, or tapered.

The upper portion of BLS 100, including an end of upper buoyant unit 110 and a portion of buoyant members 113, penetrates the surface S of the body of water, as shown in FIG. 1. Platform 10 is attached to the ends of upper buoyant unit 110 and buoyant members 13 that protrude above surface S. In addition to providing a stable platform for mechanical and/or human operations, buoyant unit 110 and restraining unit 120 can provide protection for and lateral bracing of drilling and production risers (not shown) which extend from the seabed to the surface of the platform. Preferably, the risers are routed within the BLS for their entire length, or for at least a portion of their length within the pile of the buoyant unit, and pass through the transition unit to the outside of the BLS.

While tubular pile 111 is shown as having a circular cross-section. Tubular pile 111 and all tubular or circular members herein are understood to include a variety of other cross-sectional shape members. It is preferable that the cross-sectional shapes be symmetric. Exemplary shapes include round, square, and many-sided regular and irregular shapes. Tubular pile 111 defines a central axis which is vertical when the pile is at rest (i.e., when it is not subject to horizontal forces), as can be seen, for example, in FIGS. 1 and 2.

Figure 2:
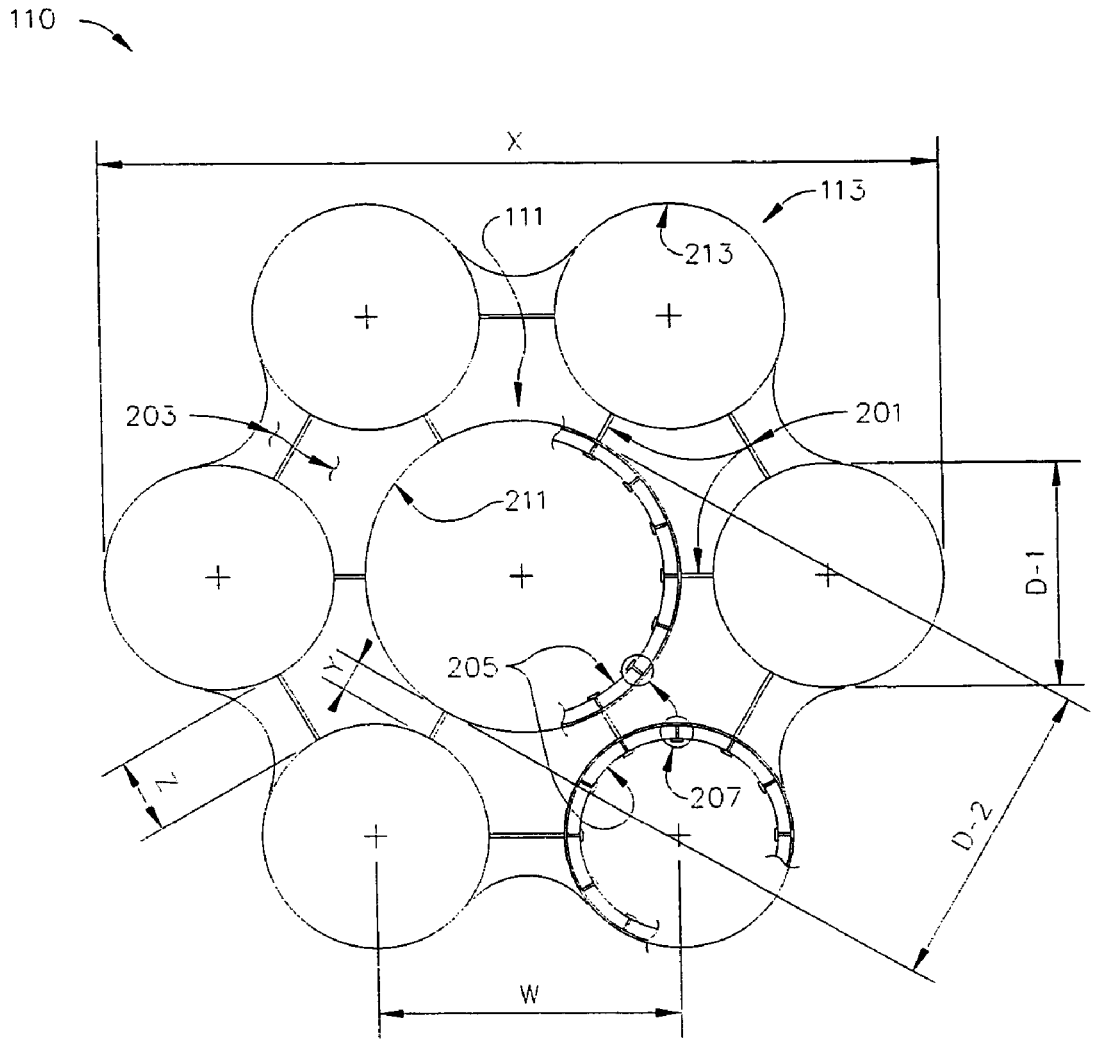
FIG. 2 is a sectional view through the buoyant unit of the first embodiment, indicated as section 2—2 in FIG. 1.

FIG. 2 is a sectional view through buoyant unit 110 of the first embodiment, indicated as section 2—2 in FIG. 1. In a preferred embodiment, tubular buoyant members 113 each have the same diameter, D-1, and are evenly distributed about pile 111 having diameter D-2, where the diameter D-1 is less than the diameter D-2. Pile 111 and buoyant members 113 are joined, supported, and spaced by a plurality of web plates 201 that are aligned with the length of the pile and diaphragm plates 203 that are aligned perpendicular to the length of the pile. Plates 201 and 203 are intermittently spaced between pile 111 and buoyant members 113 to provide spacing of the pile and buoyancy members and to provide rigidity to buoyant unit 110. The size, shape and placement of plates 201 and 203 are selected to connect pile 111 and buoyant members 113 in a structurally satisfactory manner that will prevent structural failure and limit movement between the pile and buoyant members.

Buoyant members 113 are spaced a distance Z from each other, giving a center-to-center spacing of W, and the buoyant members are spaced from pile 111 by a distance Y. The number, spacing and rigidity of plates 201 and 203 depends on the diameters of pile 111 and buoyancy members 113, taking into account the worst case environmental conditions which may be encountered where the BLS 100 is moored. In a preferred embodiment, plates 201 and 203 provide the required rigidity at an acceptable cost, while minimizing the forces on the BLS 100 from the wind, waves, and currents, and also reduces or eliminates the formation of localized vortices that may result in vortex induced vibration. In an alternative embodiment spacing between buoyant members 113 and pile 111 are provided by at least one truss.

The interior of buoyant members 113 is hollow and is at least partially filled with a buoyant material such as air, and may also include a ballast material, such as water or crude oil. In the embodiment shown in FIG. 2 the diameter of pile 111 is not the same as the diameter of buoyant members 113. In general, the diameter of pile 111 and members 113 can be the same or they can be different. The symmetric distribution of buoyant members 113 reduces yawing forces on BLS 100 that can result from non-symmetric wave, current or wind forces. Pile 111 has a skin 211 and buoyant members 113 each have a skin 213. Pile 111 and buoyant members 113 include ring stiffeners 205 and longitudinal stiffeners 207 to provide additional support under internal and external forces.

According to one aspect of the present invention, buoyant members are used to increase the overall buoyancy of BLS 100. In general, the center of buoyancy of buoyant unit 110, including pile 111 and buoyant members 113, is located above the center of gravity of the BLS 100, providing a righting force to maintain platform 10 above surface S and to prevent unwanted tilting of the surface of the platform, i.e., departure of the platform surface from a horizontal orientation. Bulkhead 117 divides pile 111 into an upper buoyant portion and a lower non-buoyant portion. The overall buoyancy of BLS 100 depends on the density and distribution of buoyant material and ballast within the pile, the cross-sectional shape of the pile, and the location of bulkhead 117. The selection of the buoyancy, including the center of buoyancy, and weight, through the addition of ballast, provide a means for modifying the stability of the BLS 100 under the action of wind and water forces. The amount of ballast, which can be water, oil or any other material that is heavier than the air it displaces, is added to limit the pitch and roll of the BLS, and can alternatively be added to control tension in the tendons during storms or can be changed in response to the weight of the platform.

As is well known, vortices are sometimes formed in a cross-flow across one or more bodies, such as a current flow in the plane of section 2—2. These vortices include pressure variations that can locally interact with the bodies to induce vibrations (vortex induced vibrations). Several embodiments of the present invention address the reduction of these vibrations through structures that minimize either the shedding of vortices or the interaction of these vortices with portions of the BLS.

Figure 10:
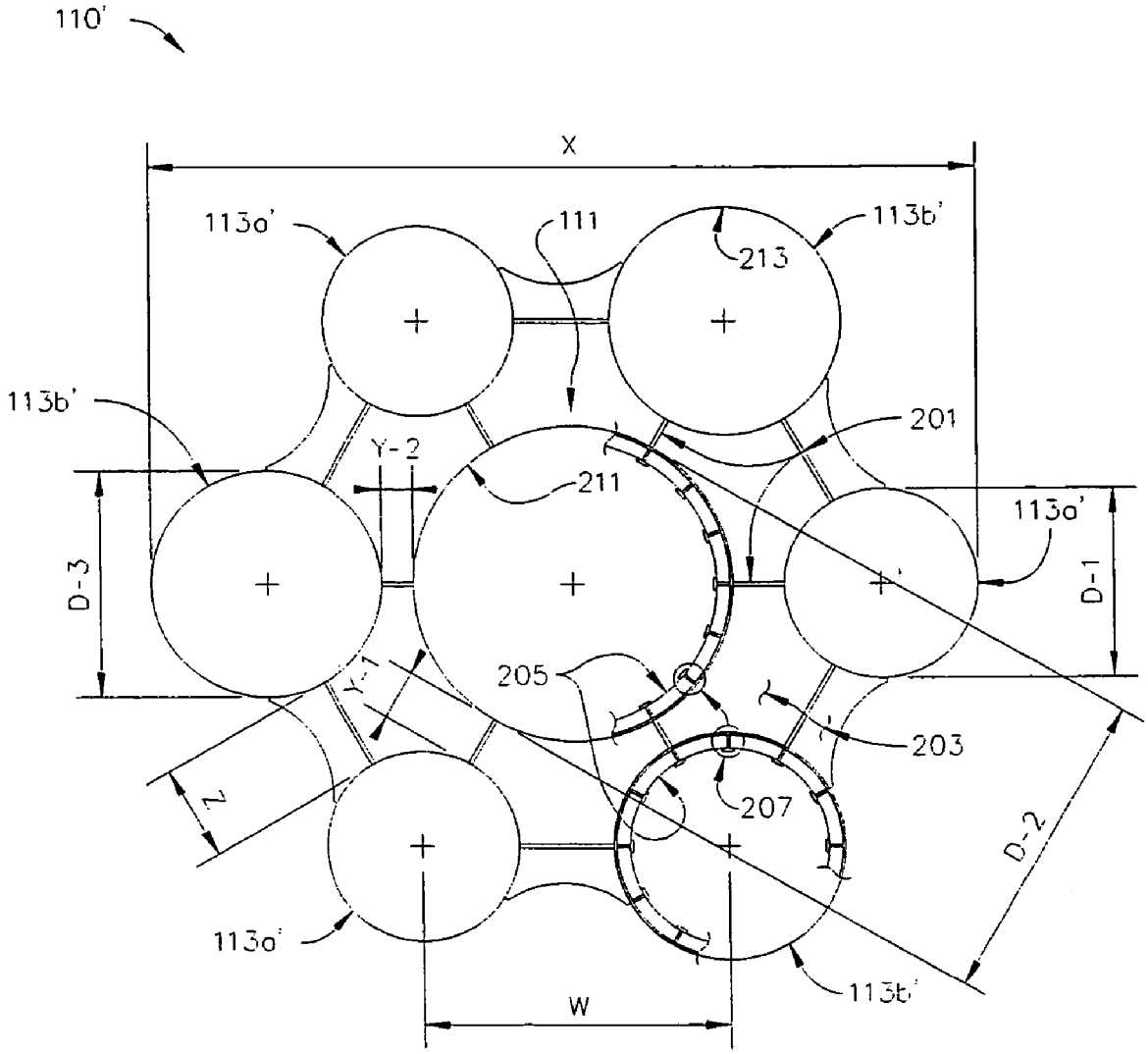
FIG. 10 is a sectional view through an alternative buoyant unit embodiment as section 2—2 of FIGS. 1, 6, 8, or 9, and having buoyant members of different diameters.

One configuration that reduces vortex induced vibrations has alternating buoyant member diameters. A specific alternative embodiment is illustrated in FIG. 10, which shows a cross-sectional view 2—2 of a buoyant unit 110' having three buoyant members 113*a*' each with a diameter D-1 and three buoyant members 113*b*', each with a diameter D-3, and where the diameter D-3 is larger than diameter D-1. As is illustrated in FIG. 10, buoyant members 113' are evenly distributed about pile 111'. It is preferable that BLS 100 be symmetric about the center of the cross section to reduce the tendency of the structure to rotate by providing buoyant members 113 that are symmetrically placed about pile 111.

Figure 8:
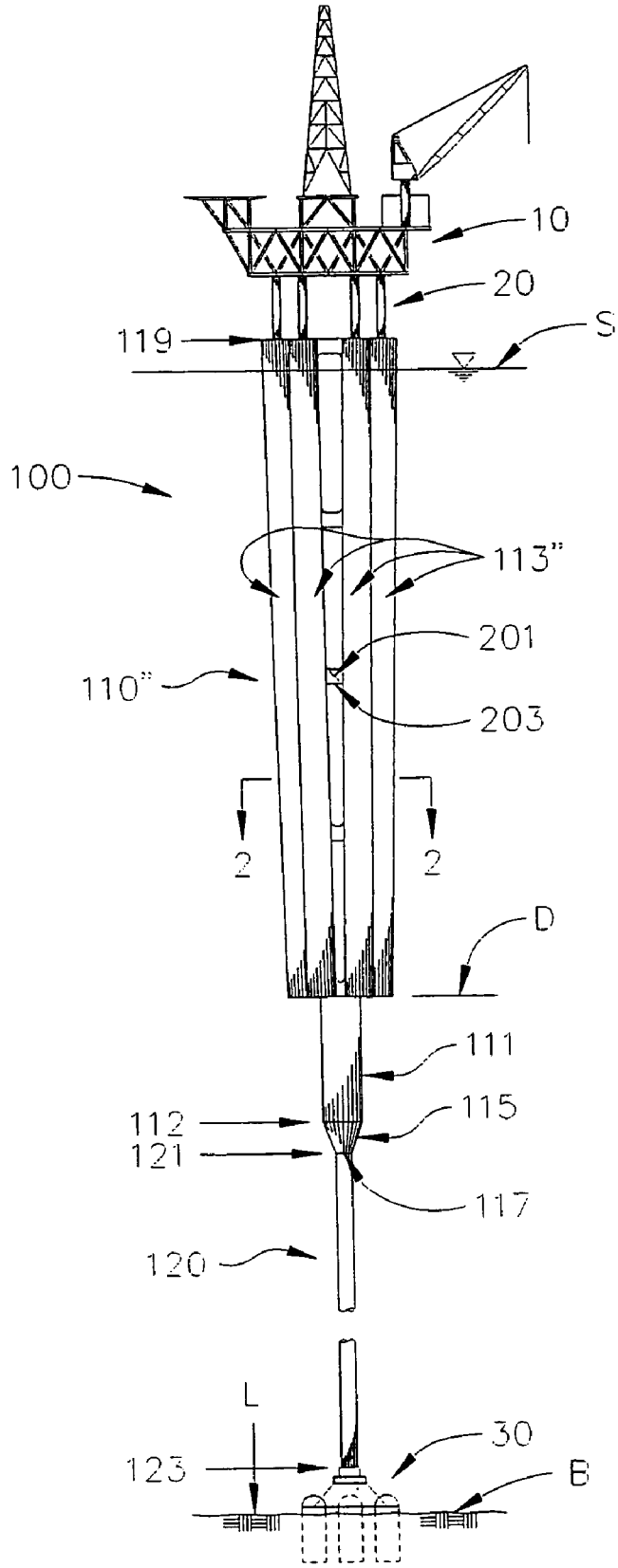
FIG. 8 is a side view of a fourth embodiment of a buoyant leg structure of the present invention having buoyant members of varying spacing.

Another configuration that reduces vortex induced vibrations varies the spacing of the buoyant members along the length of the buoyant unit. FIG. 8 is a side view of a fourth embodiment of a buoyant leg structure of the present invention having buoyant unit 110" with buoyant members 113" of varying spacing. The cross-sectional view 2—2, as illustrated in FIG. 2 or alternatively in FIG. 10, has symmetric spacing between buoyant members 113. However, the spacing between buoyant members 113' of the fourth embodiment is shown as decreasing with distance from surface S. Thus the fourth embodiment has values of W and Z that vary along the length of buoyant unit 110'. Accordingly, as can be seen from FIG. 8, in this embodiment buoyant members 113" are slightly tilted relative to the vertical, such that each defines a central axis therethrough which is not vertical, i.e., the central axis of each buoyant member is not parallel to the central axis of BLS pile 111 or with each other. In general, the spacing may vary by having a spacing that varies along the length to reduce the tendency of the BLS 100 to vibrate.

This may include portions where the spacing remains constant, or where the spacing changes with increasing depth.

Figure 9:
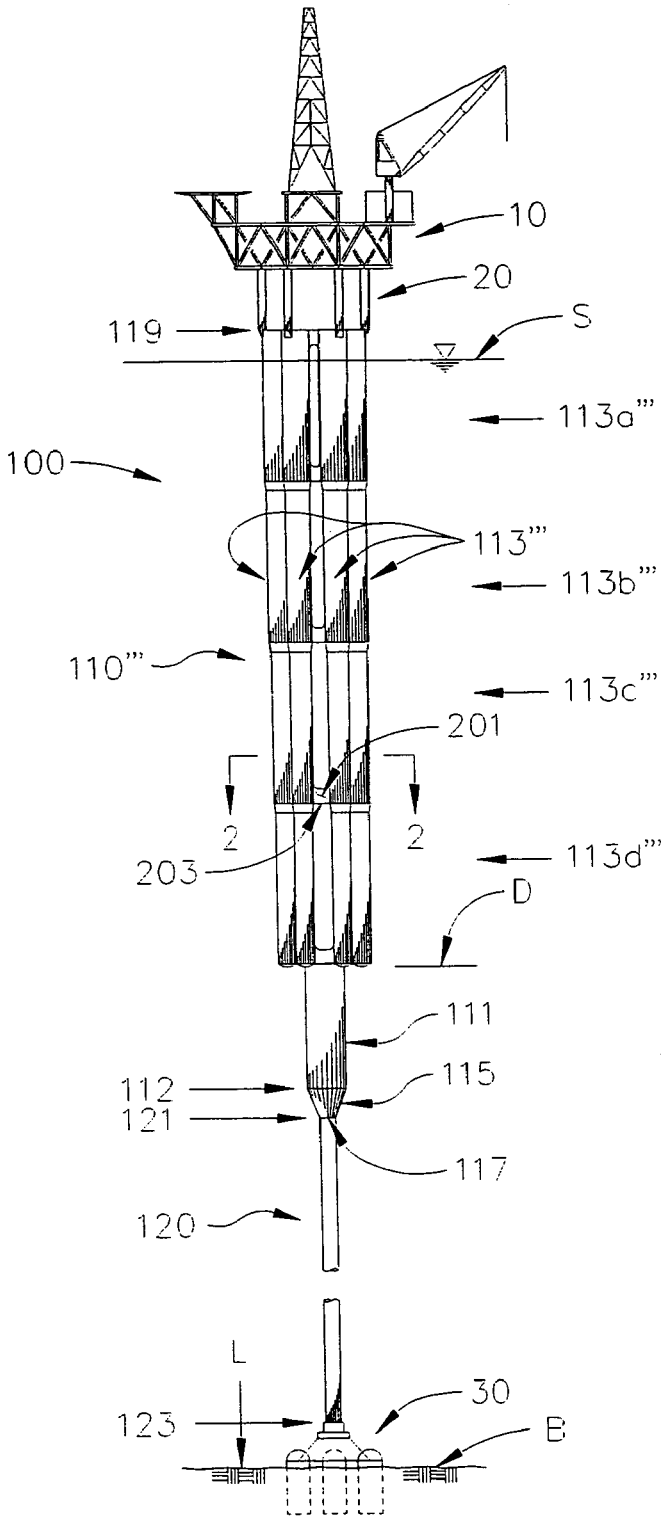
FIG. 9 is a side view of a fifth embodiment of a buoyant leg structure of the present invention having buoyant members of varying diameter.

Yet another configuration that reduces vortex induced vibrations includes buoyant members 113 having diameters that vary along the length of buoyant unit 110. FIG. 9 is a side view of a fifth embodiment of a buoyant leg structure of the present invention having a buoyant unit 110''' with buoyant members 113''' of varying diameter. Specifically, buoyant members 113''' are segmented into four sections: 113*a*'''', 113*b*''', 113*c*''', and 113*d*'''. The cross-section of members 113''' is illustrated in cross-sectional view 2—2, as illustrated in FIG. 2 or alternatively in FIG. 10, with each section of members 113''' having different values of spacing (W and Z)

Figure 3:
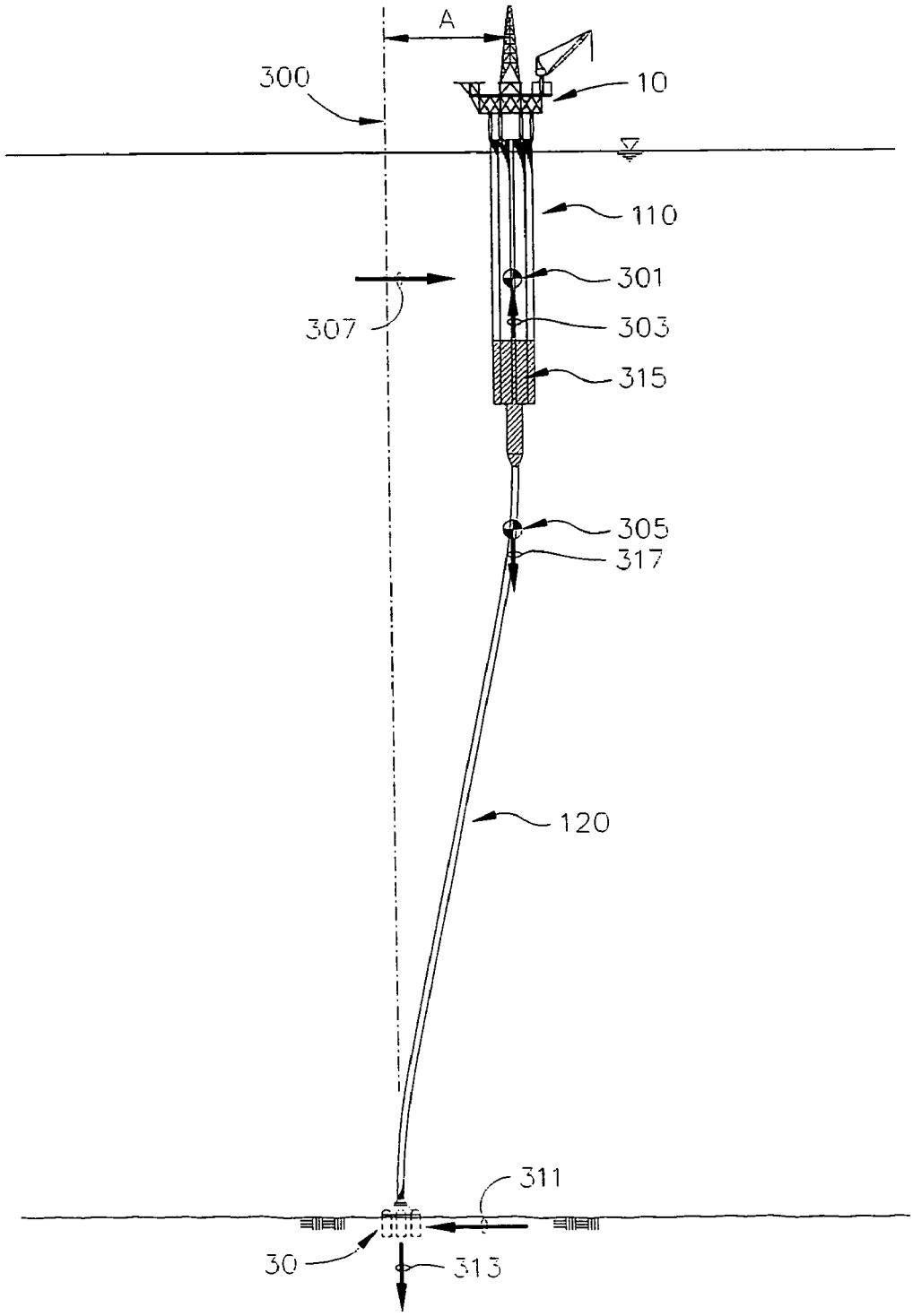
FIG. 3 is side view of the first embodiment where the platform is laterally displaced.

In the absence of lateral forces, BLS 100 assumes a vertical orientation as shown in FIG. 1. Buoyant unit 110 provides an upward force that is balanced by the weight of the BLS 100 and the holding force exerted by anchorage 30. A schematic showing the effect of lateral forces on BLS 100 is shown in FIG. 3 as a side view, where platform 10 is laterally displaced by a distance A from a line 300 representing the unperturbed position of BLS 100. Since BLS 100 is a moored, buoyant structure, it has limited horizontal and vertical movement about the mooring. Buoyant member 110 maintains a substantially vertical orientation, while restraining unit 120 accommodates the lateral movement of BLS 100 by bending. Since restraining unit 120 is in tension and is relatively flexible in comparison with the remaining structure, it bends in response to the lateral forces, as depicted in FIG. 3, with the bending occurring mostly at upper end 121 and lower end 123, so the restraining unit 120 remains relatively straight in the central portion.

As the result of the lateral forces (i.e., wind, current, waves) acting on BLS 100, combined forces represented by an external force 307 act on BLS 100, displacing the structure distance A. Also shown in FIG. 3 is a center of buoyancy 301 and a center of gravity 305 corresponding to the positions where a buoyancy force 303 and a gravitational force 317 may be viewed as acting on BLS 100, respectively.

In general, a vertical reaction force 313 is exerted by anchorage 30 to counteract the buoyancy and gravitational forces 303 and 317, and in reaction to external force 307, a horizontal reaction force 311 is exerted on BLS 100 at the anchorage. As a result of the displacement A, buoyancy force 303 and gravitational force 317 are displaced horizontally with respect to reaction force 313. Although buoyancy force 303 and gravitational force 317 can also be displaced vertically, this is a secondary effect since the lateral displacement is generally small in comparison to the height of BLS 100. The lateral displacement of the vertical forces 303, 317, and 313 generates a righting moment where the BLS 100 is fixed to anchorage 30 that tends to right the BLS. It is an important feature of the present invention that center of buoyancy 303 is located above center of gravity 305. This relationship between the vertical forces provides stability in the vertical direction by maintaining platform 10 vertical and above surface S and by resisting pitching of the platform, and generates a righting moment. In a preferred embodiment, buoyant unit 110 contains ballast 315 to lower the center of gravity and further increase the resistance of platform 10 to pitching motions.

Restraining unit 120 accommodates the external forces on BLS 100 through tension and lateral forces that stretch and bend the unit. BLS 100 is adapted for use in very deep waters with restraining unit 120 having a length-to-diameter of several hundred to several thousand to one, allowing the restraining unit to flex a significant amount. It is important that the flexure occurs without high bending stresses that may fatigue the restraining unit material and limit its lifetime.

A preferred embodiment of the present invention useful for deepwater operation may be constructed within the following parameters. The depth of water L can range from approximately 600 ft to approximately 10,000 ft or more, and is preferably more than 1,000 ft. Buoyant unit 110 preferably extends from above surface S to a depth D of hundreds of feet, preferably at least approximately 400 ft. Buoyant members 113 have equal diameters d that may be in the range of from 10 to 35 ft, or larger. In one embodiment there are six buoyant members of approximately 20 ft in diameter, symmetrically distributed about a center pile 111. Pile 111 of buoyant unit 110 also has a diameter d, as shown in FIG. 2, that is larger than that of buoyant members 113, though other embodiments may include piles of different diameter than the buoyant members. Alternatively, pile 111 is bigger than the surrounding members 113. For example, pile 111 may be up to 50 feet or greater in diameter, and members 113 are 10 to 35 ft, or larger, in diameter. Those skilled in the art will appreciated that the various structural components, such as buoyant members 113, pile 111, restraining unit 120, webs, etc., are preferably constructed of steel suitable for marine use.

Figure 4:
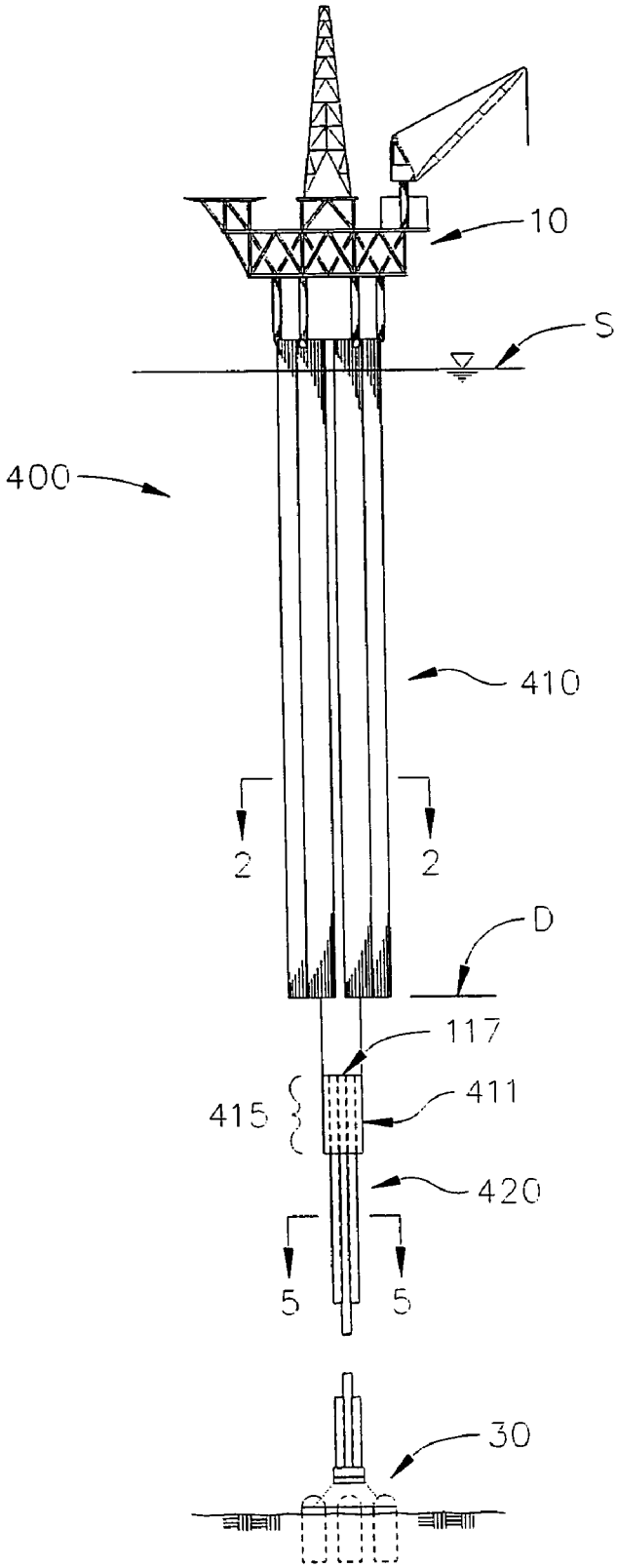
FIG. 4 is a side view of a second embodiment of a buoyant leg structure of the present invention having a multiple member restraining unit.
Figure 5:
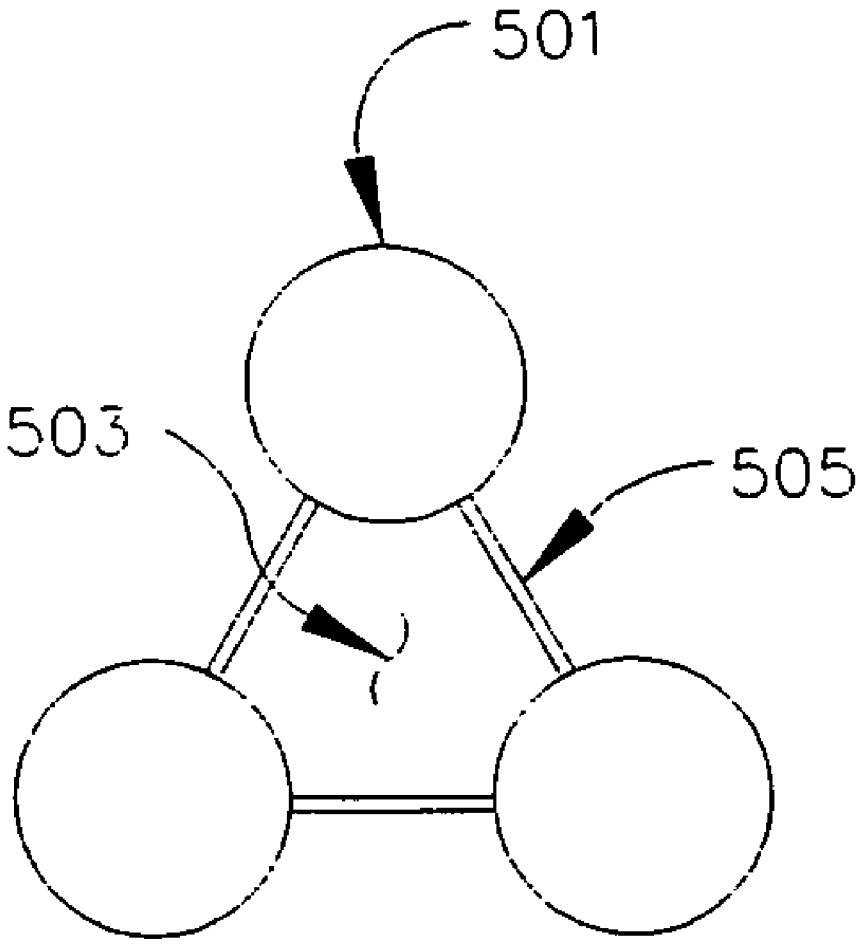
FIG. 5 is a sectional view through the restraining unit of the second embodiment, indicated as section 5—5 in FIG. 4.

FIG. 4 is a side view of a second embodiment BLS 400 having a multiple member restraining unit 420, and FIG. 5 is a sectional view 5—5 through the restraining unit of the BLS. BLS 400 has a pile 411 extending the length of the BLS, and has an upper, buoyant unit 410 and lower restraining unit 420. The portion of pile 411 within buoyant unit 410 has a construction similar to that of buoyancy unit 110, as indicated by the common buoyant unit sectional view 2—2. The portion of pile 411 forming restraining unit 420 has more than one member; specifically it includes three legs 501 that are moored at anchor 30. The use of a restraining unit with multiple legs provides several benefits that are realized for two or more legs. For example, such a construction enhances the overall strength of the pile, provides redundancy in the event that one of the legs of the restraining unit fails and may reduce the likelihood or amplitude of forces from vortex shedding.

In the embodiment of FIGS. 4 and 5, structure is included for spacing legs 501 so that the legs do not move axially and impact one another. Legs 501 are interconnected by horizontal diaphragms 503 and longitudinal webs 505 that are distributed along the length of restraining unit 420. Alternatively, the legs 501 can be held together by circumferential bands and an elastic material, such as rubber, to provide spacing between the legs (not shown). This alternative allows for a small amount of relative longitudinal movement between legs 510.

Pile 411 changes from the cross-sectional shape of FIG. 2—2 to that of FIG. 5—5 over some length of BLS 400 indicated as a transition portion 415. In one embodiment, the multiple member restraining unit 420 has a bulkhead 117 at the top of portion 415, and portion 415 flooded with ballast.

A BLS has many modes of oscillation that depend on the stiffness, mass, buoyancy and length of the structure. In order to maintain a stable platform, it is important that the periods of these modes do not correspond with periods of water or air motion that might excite a natural mode of the BLS. When the modes of oscillation of the BLS have periods that overlap with the energy spectra of the surrounding water, there is a possibility that oscillations of the BLS can be amplified, producing a very unstable situation and, possibly, catastrophic failure of the platform support structure.

One particular mode of concern for deep-water BLS is the up-and-down motion of heave. The wave energy spectrum for deep water is particularly strong in the range of 6 to 18 seconds. For water depths below 7000 ft, the heave natural period for the BLS shown in FIGS. 1–5 is approximately 5 seconds. As the water depth increases, the heave natural period of a BLS increases and can approach the 6 to 18 second range of the deep-water energy spectra. One way to decrease the natural period of the BLS is to change the axial stiffness of the buoyant unit by tethering the restraining leg to the anchor and by the selection of the buoyancy and weight of the BLS. Specifically, by selecting a tether having an elastic modulus less than that of the restraining leg, the axial stiffness can be decreased to acceptable level with a natural heave period greater than 18 seconds. Either a single or multiple strand cable of either steel or polyester can obtain the appropriate elastic modulus.

Figure 6:
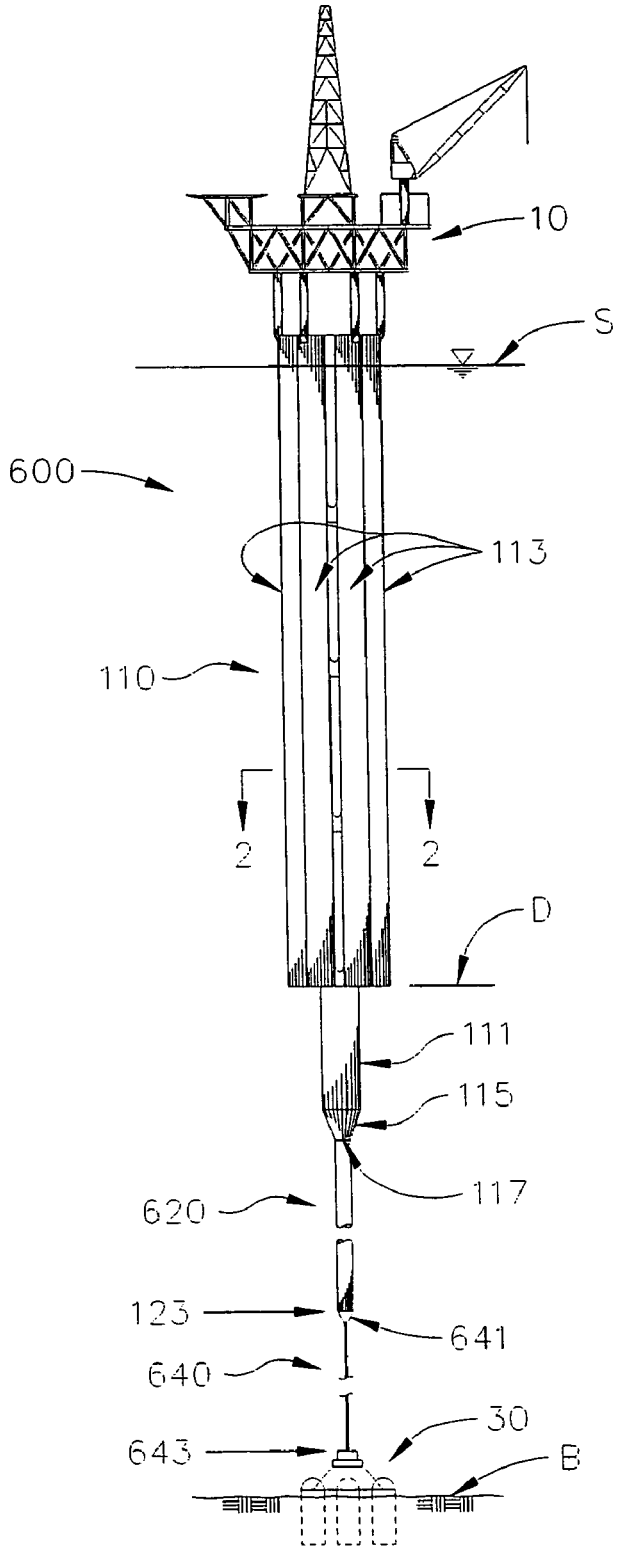
FIG. 6 is a side view of a third embodiment of a buoyant leg structure of the present invention wherein the restraining unit is tethered to the seabed.
Figure 7:
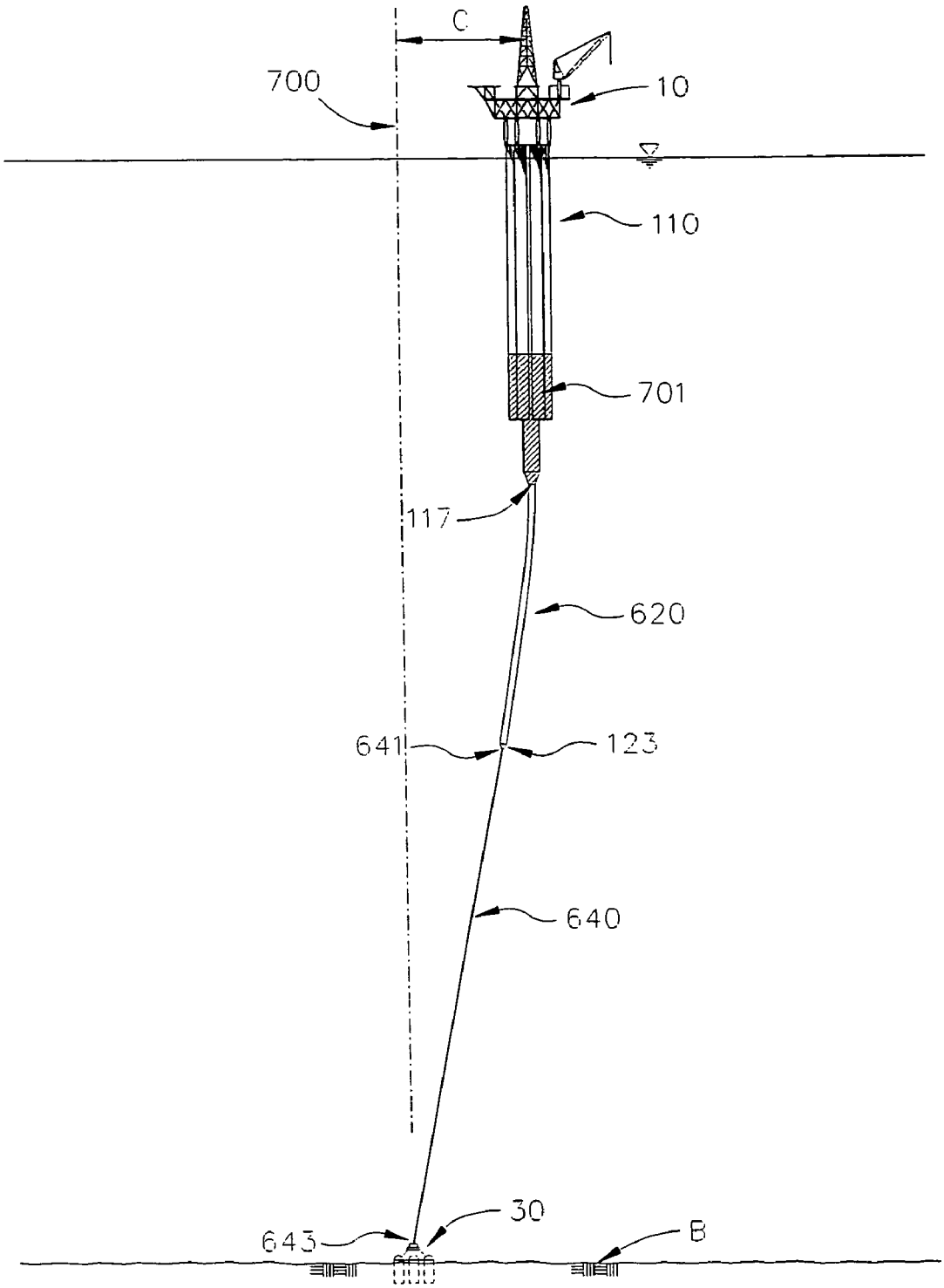
FIG. 7 is side view of the third embodiment where the platform is laterally displaced.

FIG. 6 is a side view of a third embodiment of a BLS 600, wherein the restraining unit is tethered to the seabed, and FIG. 7 is side view of the third embodiment, where the platform is laterally displaced a distance C. BLS 600 has buoyant unit 110 and elongated tubular member 111 similar to those of the first embodiment BLS 100. A restraining unit 620 includes the lower end of member 111 and a tether 640 that extends from a lower end 643 attached to anchor 30 to an upper end 641 that is attached to the lower end 123 of member 111. It is preferable that the lower end of restraining unit 620 is long and flexible enough so that most or all bending occurs in restraining unit 620. This has the advantage of reducing stress concentrations in tether 640 and restraining buoyant unit 110 from pitching and rolling.

The use of tether to moor BLS 600 may allow the structure to yaw more easily that a BLS having a pile connected to the seabed, as in BLS 100. If necessary, the increased tendency to yaw can be overcome by the addition of supplemental moorings.

The invention has now been explained with regard to specific embodiments. Variations on these embodiments and other embodiments may be apparent to those of skill in the art. It is therefore intended that the invention not be limited by the discussion of specific embodiments. It is understood that the examples and embodiments described herein are for illustrative purposes only and that various modifications or changes in light thereof will be suggested to persons skilled in the art and are to be included within the spirit and purview of this application and scope of the appended claims.

We claim:

1. A deep-water support system for supporting a structure adjacent to the surface of a body of water, comprising:

a buoyant leg structure (BLS) defining a vertical resting axis;

a plurality of elongate tubes attached to the upper portion of said BLS for enhancing the buoyancy thereof and for reducing vortex induced vibration, wherein each of said elongate tubes is at least partially filled with buoyant material such that each of said tubes has a net buoyancy which helps support the structure, and wherein each of said tubes defines a central axis therethrough, and wherein said central axis of each tube is not parallel to the resting axis of the BLS.

2. The deep-water support of claim 1 wherein said BLS extends to the bottom of said body of water and is attached to said bottom.

3. The deep-water support of claim 1 further comprising a tether which is connected to said BLS and anchored to the bottom of said body of water.

4. A deep-water support system for supporting a structure adjacent to the surface of a body of water, comprising:

a buoyant leg structure (BLS);

a plurality of elongate tubes attached to the upper portion of said BLS for enhancing the buoyancy thereof and for reducing vortex induced vibration, each of said elongate tubes being at least partially filled with buoyant material such that said tubes have a net buoyancy which helps support the structure, at least two of said elongate tubes having a different cross-sectional diameter at any given depth below the surface of said body of water.

5. The deep-water support system of claim 4 wherein said plurality of elongate tubes comprises at least two tubes having a first diameter and two tubes having a second diameter which is different than said first diameter.

6. The deep-water support system of claim 5 wherein said plurality of elongate tubes comprises six tubes symmetrically arranged about said BLS, three of said tubes having said first diameter and three of said tubes having said second diameter.

7. The deep-water support system of claim 6 wherein each of said tubes is adjacent to two tubes having a different diameter.

8. The deep-water support system of claim 4 wherein each of said tubes has a first diameter at a first depth and a second diameter at a second depth.

9. The deep-water support system of claim 8 wherein each of said tubes is substantially cylindrical with a step-wise transition between said first and second diameters.

10. A deep-water support system for supporting a structure adjacent to the surface of a body of water, comprising:

a buoyant leg structure (BLS);

a plurality of elongate tubes attached to the upper portion of said BLS for enhancing the buoyancy thereof and for reducing vortex induced vibration, each of said elongate tubes being at least partially filled with buoyant material such that said tubes have a net buoyancy which helps support the structure, at least some of said elongate tubes having a diameter which varies along their length.

11. The deep-water support system of claim 10 comprising at least six substantially identical elongate tubes attached.

12. The deep-water support system of claim 10 wherein at least some of said elongate tubes have a tapered shape.

13. The deep-water support system of claim 10 wherein at least some of said elongate tubes have a diameter which varies in step-wise fashion.

14. A deep-water support system for supporting a structure adjacent to the surface of a body of water, comprising:

a spar-like structure;

a plurality of elongate tubes attached to said spar-like structure for enhancing the buoyancy thereof and for reducing vortex induced vibration, each of said elongate tubes being at least partially filled with buoyant material such that said tubes have a net buoyancy which helps support the structure, and wherein each of said tubes defines a central axis therethrough, and wherein the axis of each tube is not vertical and is not parallel to the axis of any of the other tubes.

15. The deep-water support system of claim 14 wherein said spar-like structure comprises a generally cylindrical tube having a vertical central resting axis.

16. The deep-water support system of claim 15 wherein spar-like structure extends to a depth of at least approximately 400 feet below the surface of the body of water.

17. The deep-water support system of claim 14 wherein said plurality of elongate tubes are symmetrically arranged about said spar-like structure.

18. The deep-water support system of claim 14 wherein said elongate tubes are tapered.

19. The deep-water support system of claim 18 wherein said elongate tubes are tapered in stepwise fashion.

20. A deep-water support system for supporting a structure adjacent to the surface of a body of water, comprising:

a spar-like structure;

a plurality of elongate tubes attached to said spar-like structure, each of said elongate tubes being at least partially filled with buoyant material such that said tubes have a net buoyancy which helps support the structure, at least two of said elongate tubes having a different cross-sectional diameter at any given depth below the surface of said body of water.

* * * * *